United States Patent [19]

Bucher

[11] 4,202,381

[45] May 13, 1980

[54] RIBBON FABRIC, METHOD FOR THE MANUFACTURE THEREOF AND RIBBON LOOM FOR CARRYING OUT THE METHOD

[75] Inventor: Robert R. Bucher, Frick, Switzerland

[73] Assignee: Jakob Müller, Forschungs und Finanz AG, Frick, Switzerland

[21] Appl. No.: 812,861

[22] Filed: Jul. 5, 1977

[30] Foreign Application Priority Data

Jul. 8, 1976 [CH] Switzerland ..... 8795/76

[51] Int. Cl.[2] ..... D03D 5/00

[52] U.S. Cl. ..... 139/383 R; 139/432

[58] Field of Search ..... 139/383 R, 431, 432

[56] References Cited

U.S. PATENT DOCUMENTS

| | | | |
|---|---|---|---|
| 2,584,891 | 2/1952 | Libby | 139/383 R |
| 2,800,927 | 7/1957 | Silbermann | 139/383 R |
| 3,064,689 | 11/1962 | Plazzolla et al. | 139/432 |
| 3,403,706 | 10/1968 | Shackleton et al. | 139/432 |
| 3,550,642 | 12/1970 | Des Rosiers | 139/432 |

*Primary Examiner*—Henry Jaudon

*Attorney, Agent, or Firm*—Werner W. Kleeman

[57] ABSTRACT

A ribbon fabric, a method for manufacturing the same and a ribbon loom for carrying out the aforesaid method, wherein the ribbon fabric or tape has weft thread loops inserted from one side of the warp shed therethrough. At the other side of the warp shed a first auxiliary thread is drawn through the weft thread loops, and a second auxiliary thread, located outside of the weft thread loops is knitted with each n-th stitch of the first auxiliary thread for securing the latter.

21 Claims, 7 Drawing Figures

RIBBON FABRIC, METHOD FOR THE MANUFACTURE THEREOF AND RIBBON LOOM FOR CARRYING OUT THE METHOD

BACKGROUND OF THE INVENTION

The present invention relates to a ribbon fabric or tape of the type having weft thread loops inserted from one side of the warp shed, these weft thread loops being tied at the other side of the warp shed by means of at least one auxiliary thread, and further pertains to a method for fabricating such ribbon fabric or tape, wherein weft thread loops inserted into the warp shed are tied by at least one auxiliary thread, and additionally, relates to a ribbon loom for the performance of the aforesaid method incorporating a weft thread insertion element, and a knitting needle for tying the weft thread loops by means of at least one auxiliary thread.

From German patent publication No. 1,760,739 it is known to the art to conjointly tie the individual weft thread loops of a ribbon fabric alternately with a first auxiliary thread, a second auxiliary thread and both auxiliary threads. In this regard, the auxiliary threads in each case are guided through the weft thread loops and serve for securing such weft thread loops. There are also known to the art ribbon fabrics, for instance from German patent publication No. 2,161,013, wherein the weft thread loops are only tied by means of one auxiliary thread, and either only the auxiliary thread is knitted or in addition thereto also the weft thread loops with one another.

All of the heretofore known ribbon fabrics, where the weft thread loops are only tied by means of an auxiliary thread, even if there are alternately employed a number of auxiliary threads, or even if there are simultaneously also used a plurality of auxiliary threads, drawn however individually or conjointly in each case through the weft thread loops, have the drawback that in the case of destruction of a stitch or mesh the entire ribbon fabric unravels or disintegrates. If the weft threads and the auxiliary threads are interhooked or crocheted with one another, then the ribbon fabric is indeed secured against unravelling or disintegration upon damaging of the selvedge or edge, but however the ribbon fabric is associated with two drawbacks. Firstly, the thickness and the appearance of the edge is dependent upon the thickness and the structure of the weft thread, and secondly, the marginal or edge region at the side of the knitting needle of such ribbon fabric is many-fold looser than the remaining region, having a negative effect upon the load-bearing capability, life and appearance of the product.

SUMMARY OF THE INVENTION

Hence, it is a primary object of the present invention to provide a new improved ribbon fabric or tape which is not associated with the aforementioned drawbacks and disadvantages of the prior art constructions.

Another object of this invention aims at the provision of a new and improved method of, and ribbon loom, for producing such improved ribbon fabric or tape.

Yet a further significant object of the present invention aims at the provision of a new and improved construction of apparatus for fabricating ribbon fabrics or tapes, which apparatus is extremely simple in construction and design, highly reliable in operation, relatively economical to manufacture, easy to use, and not readily subject to breakdown or malfunction.

Now in order to implement these and still further objects of the invention, which will become more readily apparent as the description proceeds, the invention provides the following:

(a) an improved ribbon fabric or tape of the previously mentioned type which is manifested by the features that a first auxiliary thread is drawn through the weft thread loops, and a second auxiliary thread, disposed outside of the weft thread loops, is knitted with each n-th stitch or mesh of the first auxiliary thread in order to secure the latter;

(b) a method of the previously mentioned type for producing such ribbon fabric or tape, which is manifested by the features that only the first auxiliary thread is drawn through the weft thread loops and at each n-th stitch or mesh is knitted together with the second auxiliary thread which is located outside of the weft thread loops; and (c) a ribbon loom of the previously mentioned type for the performance of the aforesaid method which is manifested by the features that a thread guide for the second auxiliary thread is constructed such that for knitting the second auxiliary thread it inserts such into the knitting needle, after such has drawn a loop of the first auxiliary thread through the weft thread loop.

It has been surprisingly found that by virtue of the knotting or tying of the weft thread loops with a first auxiliary thread and due to its knotting or tying with a second auxiliary thread there is produced a ribbon fabric or tape which, upon damage of a stitch or mesh, cannot detach and unravel. By means of the second auxiliary thread which is not guided through the weft thread loops and exclusively knitted with the first auxiliary threads for securing the same, the auxiliary threads are mutually additionally clamped. Upon rupture of a stitch of both the first auxiliary thread as well as the second auxiliary thread and upon pulling at such ruptured auxiliary threads there cannot arise any opening or disintegration of the ribbon fabric or tape, quite to the contrary, the auxiliary threads tend to mutually clamp more intensely.

Such ribbon fabric or tape which is secured against undesired unravelling or disintegration is especially of extraordinary importance for use with seat belts of various types of transportation means, such as vehicles, aircraft and so forth.

By virtue of the fact that the weft thread loops are located in an undulated or serpentine configuration in the ribbon fabric or tape and are not mutually knitted, there is possible an increased weft density or set of the weft, so that the stability of the ribbon fabric or tape can be improved. It has also been surprisingly found that by means of the existing tying technique of the weft thread loops there is obtained a ribbon fabric or tape, the density of which at the marginal region or selvedge is exactly as good as in the intermediate region. In this way there is produced a greater load-carrying capability, service life and improved appearance of the ribbon fabric.

Furthermore, it is possible to draw the first and possibly also the second auxiliary thread by means of a weft thread between the warp threads, i.e. into the ribbon fabric or tape. Consequently, there is not only produced an especially well-protected knitted edge, rather there can be hardly easily determined which edge of the ribbon fabric or tape has been woven and which has been knitted.

The advantages of the new and improved ribbon fabric or tape are already then realized when the second auxiliary thread is knitted with each n-th stitch, wherein n is greater than 2. However, it is even more advantageous if the second auxiliary thread is knitted at least with each second stitch, preferably with each stitch of the first auxiliary thread. In the last-mentioned case the knitted edge is especially uniform and closed and secured extremely well.

The first auxiliary thread which ties the weft thread loops is preferably stronger than the second auxiliary thread, which only has assigned to it a securing function. It is of advantage if the second auxiliary thread is bulky or puffy, so that an increased frictional contact exists between the individual auxiliary threads and there is further rendered more difficult any drawing-out of the auxiliary threads.

The new and improved ribbon fabric or tape is especially suitable for technological uses, for instance as belts or straps. Such belts or straps can be employed, for instance, for Venetian blinds, shutters, packaging purposes, transport purposes and so forth. They can also be elastically constructed. It is particularly advantageous to use the ribbon fabric or tape for seat belts for motor vehicles. Seat belts employed in motor vehicles, as is known, are especially exposed to considerable load or wear, particularly at their selvedges or edges due to their continuous actuation or use and the deflection or twisting thereof, so that selvedge or edge damage can easily arise. In the case of safety seat belts fabricated with heretofore known needle looms, such, as a general rule, tended to open or unravel, whereas in the case of safety seat belts produced from the ribbon fabrics or tapes of the present invention, even upon damage to the selvedge or edges, such unravelling or the like cannot arise.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
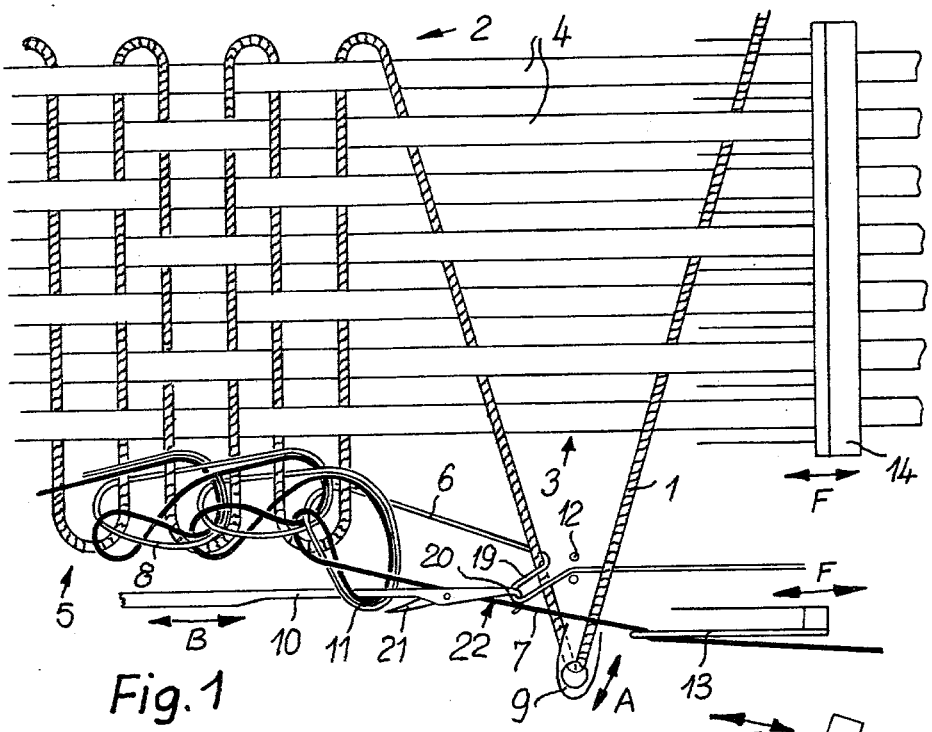
FIG. 1 is a sectional and top plan view of a ribbon fabric or tape showing the same during the manufacture thereof.
Figure 2:
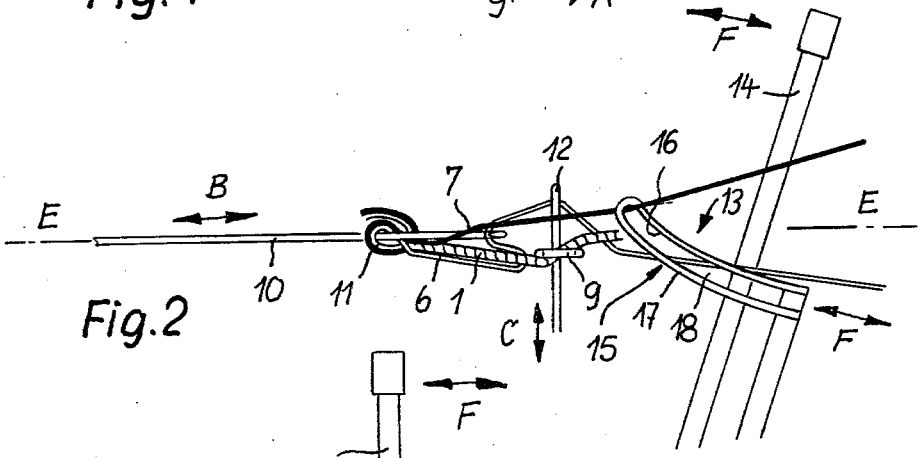
FIG. 2 illustrates in side view the manufacture of the ribbon fabric or tape of FIG. 1 during the phase of drawing-in the loop of the first auxiliary thread and the insertion of the second auxiliary thread into the knitting needle.
Figure 3:
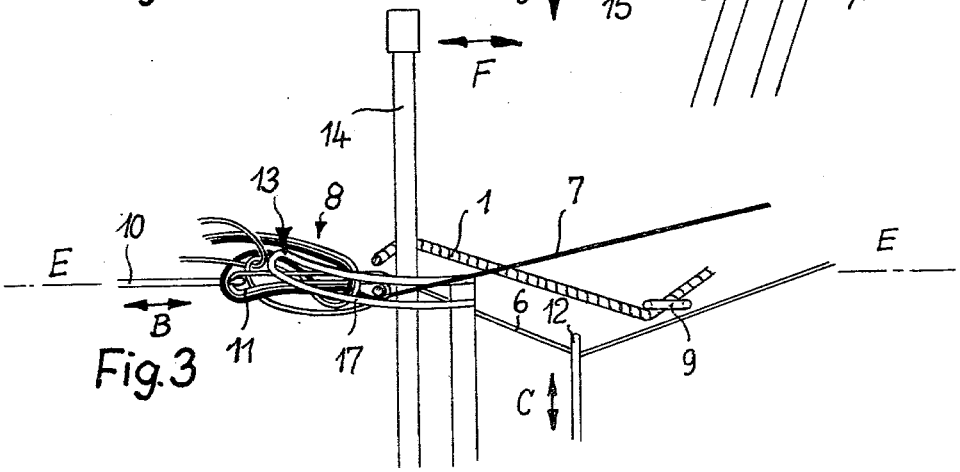
FIG. 3 also is a side view showing the manufacture of the ribbon fabric or tape of FIG. 2 during the phase of sloughing of the half-stitch and the beating-up of the weft by the reed.

The ribbon fabric or tape illustrated in FIGS. 1 and 2 will be seen to comprise weft thread loops 1 which are inserted from the weaving side 2 into a warp shed 3 between the warp threads 4. At the knitting side 5 there are tied the weft thread loops 1 by means of a first auxiliary thread 6. A second auxiliary thread 7 is knitted with each stitch or mesh of the first auxiliary thread 6. As shown in FIG. 1, the second auxiliary thread 7 is located at one side, in the illustrated embodiment at the upper side, of the weft thread. Furthermore, FIGS. 1 to 3 schematically illustrate a first ribbon loom for manufacturing a ribbon fabric or tape. This ribbon loom contains a conventional weft thread insertion element 9 which continuously inserts from the weaving side 2 of the ribbon fabric, during a to-and-fro movement A, weft thread loops 1 into the alternate warp sheds 3 of the warp threads 4. At the knitting side 5 of the ribbon fabric or tape a knitting needle 10, constructed as a tongue needle, carries out a to-and-fro movement B, in order to draw the first auxiliary thread 6 through the weft thread loop 1 and to knit such together with the second auxiliary thread 7 with the half-stitch 11 of the first auxiliary thread 6 and the second auxiliary thread 7. A thread guide 12 carries out an up-and-down movement C and serves for guiding the first auxiliary thread 6. A thread guide 13 is connected with a reed 14 of the ribbon loom and carries out its to-and-fro movement F.

The thread guide 13 of the second auxiliary thread 7 is constructed such that it guides the second auxiliary thread—with respect to a reference plane E—E defined by the knitting needle 10 and the ribbon fabric to be produced—for insertion of the second auxiliary thread 7 into the knitting needle 10 at one side of the reference plane. During the start of the forward stroke of the knitting needle 10 the thread guide 13 forces the second auxiliary thread 7 to the other side of the reference plane E—E. The thread guide 13 for the second auxiliary thread 7 contains a guide 15 which is preferably constructed as a lengthwise guide. The latter possesses a guide edge 16 and is preferably augmented by a bracket 17 into a guide slot 18. The thread guide 13 is connected and arranged such with respect to the reed 14 that during the beating-up action of the reed it approximately extends in the direction of the knitting needle 10, as best seen by referring to FIG. 3. The elongate guide 15 is furthermore advantageously constructed such that in the beat-up position of the reed 14 this guide extends from the latter in a sickle-like arc towards the reference plane E—E.

The mode of operation of the ribbon loom and thus the fabrication of the ribbon fabric or tape or the like occurs as follows:

By means of the weft thread insertion element 9 a weft thread loop 1 is inserted from the weaving side 2 of the ribbon fabric or tape into the warp shed 3 until reaching the position illustrated in FIG. 1. Then the thread guide 12 of the first auxiliary thread 6 engages from below into the inserted weft thread loop 1, as shown in FIG. 2. The knitting needle 10 is then displaced to such an extent that it engages the first auxiliary thread 6 and during its retraction can draw a loop 19 through the weft thread loop 1. The thread guide 13 of the second auxiliary thread 7 upwardly leads the second auxiliary thread 7, which is guided below the knitting needle 10, so that this second auxiliary thread 7 bears under pretension or pre-stress at the knitting needle 10 and during the rearward movement of such knitting needle 10 arrives in the open or hook-like needle head 20. During the rearward movement of the knitting needle 10 there is accomplished a return of the thread guide 12 for the first auxiliary thread 6 by lowering the thread guide 12, so that it arrives outside of the operable range of movement of the weft thread insertion element 9 and the thread guide 13 of the second auxiliary thread 7, which thread guide 13 rocks or pivots forwardly together with the reed 14.

During the course of the rearward movement of the knitting needle 10 the half-stitch 11 of the first auxiliary thread 6 and the second auxiliary thread 7 closes the tongue 21, and the knitting needle 10 draws the loop 19 of the first auxiliary thread and a loop 22 of the second auxiliary thread 7 which is forming through the half-stitch 11, and thus forms a new half-stitch while sloughing the old half-stitch, which retains its head connection and thus becomes a stitch 8. During this movement the reed 14 beats the weft thread loop 1 against the fabric. Also the thread guide 13 of the second auxiliary thread 7 is thus moved forwardly and presses the second auxiliary thread 7 to the other side of the reference plane E—E. Consequently, the knitting needle 10, during the forward movement, can travel over the second auxiliary thread 7, so that such during the retraction of the thread guide 13 comes to bear from below at the knitting needle 10. In the meantime also the warp shed 3 has changed and there can begin a new work cycle.

Since the guide 15 for the second auxiliary thread 7 is rigidly connected with the reed 14 and thus carries out its movement F, there is accomplished at such ribbon loom a knitting of the second auxiliary thread with each stitch or mesh 8 of the first auxiliary thread 6.

Figure 4:
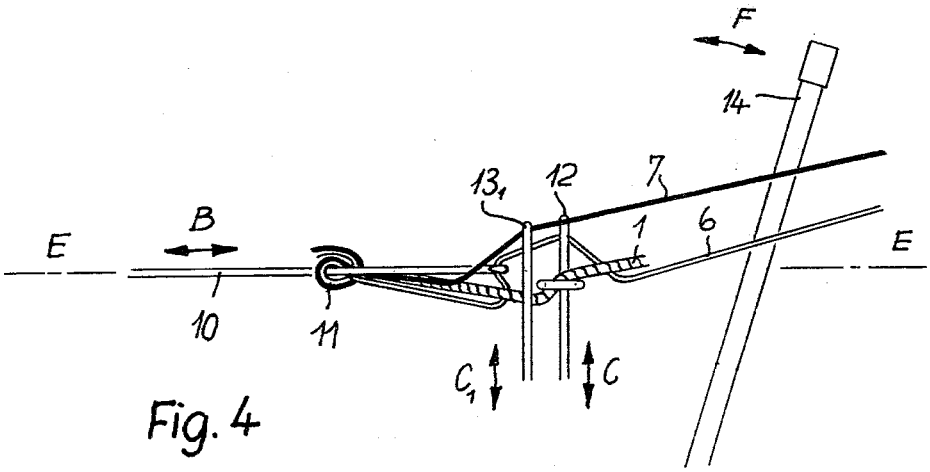
FIG. 4 illustrates the manufacture of the ribbon fabric or tape, analogous to the showing of FIG. 2, illustrating a modified thread guide for the second auxiliary thread.
Figure 5:
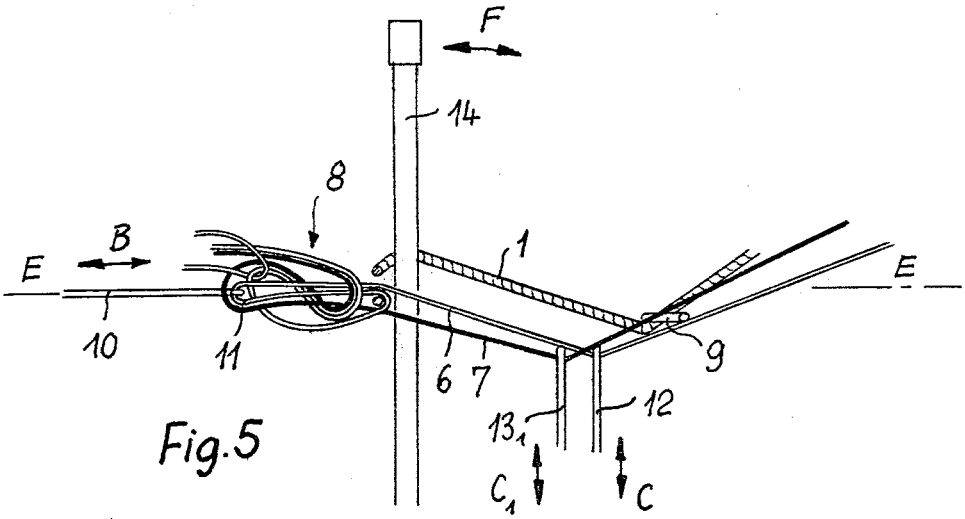
FIG. 5 illustrates the manufacture of the ribbon fabric or tape according to FIG. 4 during the phase shown in FIG. 3.

FIGS. 4 and 5 show a further exemplary embodiment of a ribbon loom, the construction of which, apart from the thread guide for the second auxiliary thread 7, corresponds to the construction of the ribbon loom of the embodiment of FIGS. 1 to 3 discussed above. Hence, generally the same or analogous components have been designated by the same reference characters as used during the description of the embodiment of FIGS. 1 to 3. The modified thread guide $13_1$ of the ribbon loom of FIGS. 4 to 5 is constructed analogous to the thread guide 12 of the first auxiliary thread 6, however the thread guide $13_1$ does not engage into the weft thread loop 1, rather is disposed between the weft thread loop 1 and the setting-on place of the ribbon fabric or tape i.e. the location of beat-up of the weft thread loop. The thread guide $13_1$ of the second auxiliary thread 7 has a not particularly referenced guide opening and carries out an up-and-down movement $C_1$. Analogous to the operation of the thread guide 13 of the ribbon loom of FIGS. 1 to 3, the thread $13_1$ also retains the second auxiliary thread 7 after sloughing of the stitch below the reference plane E—E, as will be apparent from the showing of FIG. 5, so that the knitting needle 10 can travel over the second auxiliary thread 7. In order to insert the second auxiliary thread 7 into the open knitting needle 10 the thread guide $13_1$ lifts the auxiliary thread 7 past the reference plane E—E, so that the second auxiliary thread 7 again bears under pretension or pre-stress from below against the knitting needle 10. The thread guide $13_1$ of the ribbon loom can be equipped with its own drive, so that it can be controlled in such a manner that the second auxiliary thread 7 only is knitted with each n-th stitch or mesh 8 of the first auxiliary thread 6. In the event that the second auxiliary thread 7 should be knitted with each stitch 8 of the first auxiliary thread 6, then the thread guide $13_1$ of the second auxiliary thread 7 can be combined with the thread guide 12 of the first auxiliary thread 6.

Figure 6:
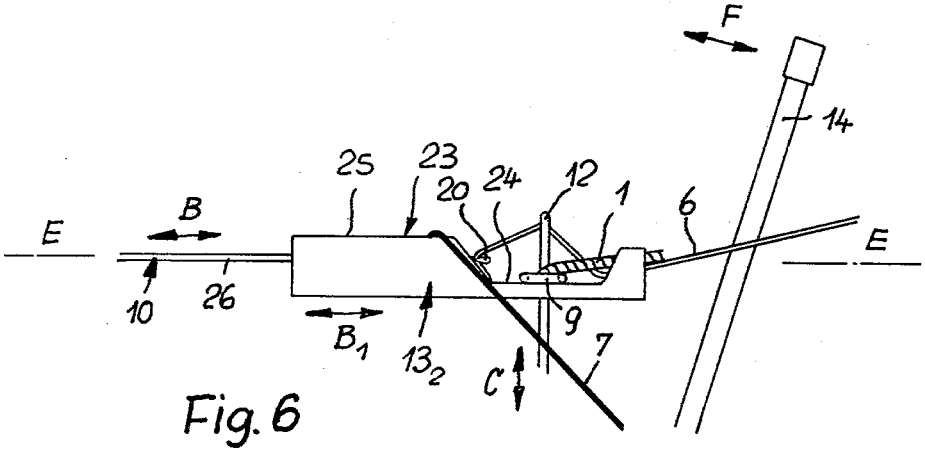
FIG. 6 illustrates the manufacture of the ribbon fabric or tape, analogous to the showing of FIG. 2, with a further modified thread guide for the second auxiliary thread.
Figure 7:
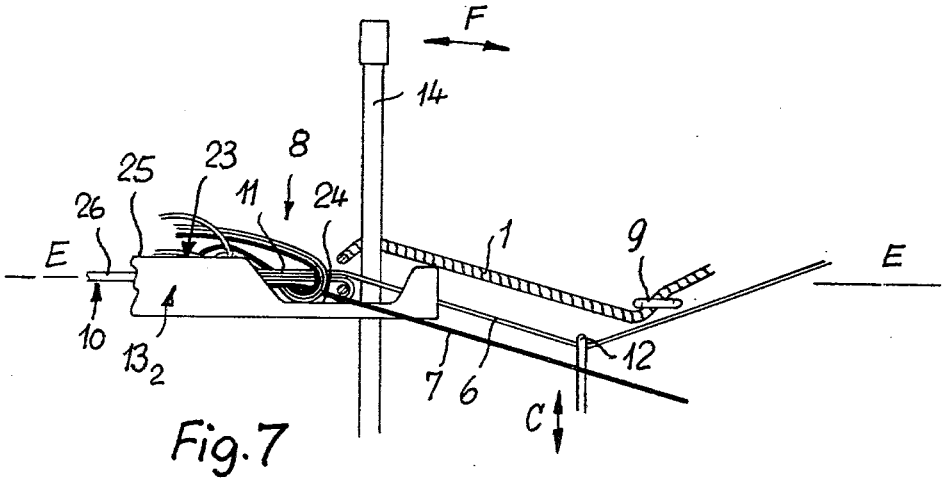
FIG. 7 illustrates the manufacture of the ribbon fabric or tape according to FIG. 6 in the phase shown in FIG. 3.

FIGS. 6 and 7 show a further exemplary embodiment of a ribbon loom, which apart from the thread guide $13_2$ for the second auxiliary thread 7, is constructed analogous to the ribbon loom of FIGS. 1 to 5, so that again, as a matter of convenience the same or analogous components have been designated with the same reference characters and the prior disclosure again is applicable with regard to this modification.

As to the differences which should be here indicated, the thread guide $13_2$ of the second auxiliary thread 7, for the ribbon loom of FIGS. 6 and 7, is coupled with the knitting needle 10 and possesses a guide cam 23. The guide cam portion 24 which is disposed before and at the start of the needle head is located at one, namely the lower side of the reference plane E—E. The therewith merging or following guide cam portion 25, confronting the shaft 26 of the knitting needle 10, is located at the other, upper side of the reference plane E—E. The thread guide $13_2$ carries out the same movement $B_1$ as the knitting needle 10. With this ribbon loom the second auxiliary thread 7 is guided such that it always bears against the guide cam portions 24 and 25. Since the guide cam portions, in the embodiment under discussion, are situated at the top, the second auxiliary thread 7 is guided downwardly below the reference plane E—E.

The mode of operation of this thread guide $13_2$ for the second auxiliary thread 7 is analogous to what has been disclosed for the above-considered exemplary embodiments. As shown in FIG. 7, the second auxiliary thread 7, after the sloughing of the stitch 8 from the knitting needle 10, contactingly bears against the guide cam portion 24 which is located beneath the reference plane E—E. Consequently, it is possible for the knitting needle 10, during the forward stroke, to travel over the second auxiliary thread 7. Since the knitting needle 10 entrains the thread guide $13_2$ of the second auxiliary thread 7, the second auxiliary thread 7 arrives from the guide cam portion 24 at the guide cam portion 25, which is located over the reference plane E—E, so that the second auxiliary thread 7 can be brought from below into contact with the knitting needle 10. Hence, analogous to the above-described ribbon looms there can be ensured that the second auxiliary thread 7 can be positively brought into contact or engagement with the knitting needle 10.

Since the thread guide $13_2$ for the second auxiliary thread 7 is coupled with the knitting needle 10, it carries out its movement, so that with this ribbon loom the second auxiliary thread 7 is knitted with each stitch of the first auxiliary thread 6.

With all of the illustrated variant constructions of the thread guide, the guide cams or thread guide movements, respectively, are to be structured or controlled such that the knitting needle 10 travels below the second auxiliary thread 7 and during the rearward travel is inserted from above downwardly into the hook of the knitting needle.

The ribbon looms can be equipped with transport devices for the first and second auxiliary threads, rendering possible a different feed of the first auxiliary thread and the second auxiliary thread. In this way there can be achieved the result that the first auxiliary thread has imparted to it a pre-feed or pre-transport, i.e. is at a lower tensional stress that the second auxiliary thread. Consequently, there is facilitated drawing-in of the stitch of the auxiliary threads between the warp threads of the fabric.

While there are shown and described present preferred embodiments of the invention, it is to be distinctly understood that the invention is not limited thereto, but may be otherwise variously embodied and practiced within the scope of the following claims. Accordingly,

What I claim is:

1. A ribbon fabric having weft thread loops inserted from one side of a warp thread shed, a first auxiliary thread drawn through the weft thread loops and forming stitches, and a second auxiliary thread located externally of the weft thread loops knitted with each n-th stitch of the first auxiliary thread in order to secure the latter.

2. The ribbon fabric as defined in claim 1, wherein $n=1$.

3. The ribbon fabric as defined in claim 1, wherein $n=2$.

4. The ribbon fabric as defined in claim 1, wherein n exceeds the value of 2.

5. The ribbon fabric as defined in claim 1, wherein the first auxiliary thread is stronger than the second auxiliary thread.

6. The ribbon fabric as defined in claim 1, wherein the second auxiliary thread is bulky.

7. The ribbon fabric as defined in claim 1, wherein at least the stitches of the first auxiliary thread are at least partially drawn-in between the warp threads.

8. A method of manufacturing a ribbon fabric comprising the steps of:

providing warp threads;

forming warp sheds from the warp threads;

inserting weft thread loops into a formed warp shed;

drawing only a first auxiliary thread through the weft thread loops, and for each n-th stitch knitting together the first auxiliary thread with a second auxiliary thread which is located outside of the warp thread loops.

9. The method as defined in claim 8, wherein n amounts to 1.

10. The method as defined in claim 8, wherein n amounts to 2.

11. The method as defined in claim 8, wherein n is greater than the value of 2.

12. The method as defined in claim 8, including the steps of laying the second auxiliary thread for knitting into an open knitting needle as soon as such has drawn a loop of the first auxiliary thread through one of the weft thread loops.

13. The method as defined in claim 12, further including the steps of:

selecting n to amount to 1, and guiding the second auxiliary thread by means of a thread guide which is connected with a reed.

14. The method as defined in claim 12, further including the steps of guiding the second auxiliary thread by means of a driven thread guide.

15. The method as defined in claim 14, further including the steps of utilizing as the driven thread guide a driven thread guide which is connected with a thread guide of the first auxiliary thread.

16. The method as defined in claim 12, including the steps of selecting n to amount to the value 1, and guiding the second auxiliary thread by means of a thread guide connected with the knitting needle.

17. The method as defined in claim 8, further including the steps of drawing the stitches of the first auxiliary thread by means of the weft thread loops between the warp threads.

18. The method as defined in claim 8, further including the steps of drawing the stitches of the first auxiliary thread and the second auxiliary thread by means of the weft thread loops between the warp threads.

19. The method as defined in claim 8, further including the steps of pre-feeding the second auxiliary thread with respect to the first auxiliary thread.

20. A ribbon fabric produced according to the method of claim 8.

21. A ribbon fabric having weft thread inserted as double picks from one side of the warp and extending thereacross with their looped end portions extending along the opposite side of the warp, a first auxiliary thread drawn through the weft end loops and forming stitches, and a second auxiliary thread located externally of the weft end loops knitted with at least certain of the stitches of the first auxiliary thread in order to secure the latter.

* * * * *